United States Patent [19]

Warchol

[11] 4,381,205

[45] Apr. 26, 1983

[54] METAL QUENCHING PROCESS

[75] Inventor: Joseph F. Warchol, West Norriton, Pa.

[73] Assignee: E. F. Houghton & Company, Valley Forge, Pa.

[21] Appl. No.: 365,531

[22] Filed: Apr. 5, 1982

[51] Int. Cl.[3] ..... C21D 1/56

[52] U.S. Cl. ..... 148/18; 148/20.6; 148/28; 568/46; 568/614; 568/616; 568/618; 568/623; 568/624

[58] Field of Search ..... 148/18, 20.6, 28

[56] References Cited

U.S. PATENT DOCUMENTS

| | | | |
|---|---|---|---|
| 2,425,755 | 8/1947 | Roberts et al. | 568/618 |
| 3,036,118 | 5/1962 | Jackson et al. | 568/623 |
| 3,220,893 | 11/1965 | Blackwood et al. | 148/28 |
| 3,595,924 | 7/1971 | Kalopissis et al. | 568/614 |
| 3,706,714 | 12/1972 | Lloyd et al. | 568/624 |
| 3,829,505 | 8/1974 | Herold | 568/46 |
| 3,902,929 | 9/1975 | Meszaros | 148/28 |
| 4,087,290 | 5/1978 | Kopietz et al. | 148/48 |
| 4,288,639 | 9/1981 | Camp | 568/616 |

FOREIGN PATENT DOCUMENTS

| | | | |
|---|---|---|---|
| 2411827 | 9/1975 | Fed. Rep. of Germany | 148/28 |

*Primary Examiner*—Veronica O'Keefe
*Attorney, Agent, or Firm*—Howson and Howson

[57] ABSTRACT

A process of quenching metal using as the quenching medium an aqueous solution containing from about 0.5% to 50% by weight of a liquid, water-soluble, capped polyether polyol obtained by reacting ethylene oxide and at least one lower alkylene oxide having 3 to 4 carbon atoms, e.g. propylene oxide, with an active hydrogen compound, such as a lower glycol, to prepare a heteric or block copolymer, and further reacting the copolymer with an alpha olefin oxide, the polyol having a molecular weight of from about 7000 to 15,000.

7 Claims, No Drawings

METAL QUENCHING PROCESS

BACKGROUND OF THE INVENTION

This invention relates to the heat treatment of metals and more particularly to a novel process for quenching metals.

In order to modify the physical properties of metals and their alloys, various methods of heat treatment have been devised in which the metal is heated to a given elevated temperature and then cooled. Generally the cooling takes place at a relatively rapid rate, and such cooling is commonly referred to as "quenching." Quenching is accomplished by immersing the hot metal in a liquid bath, usually water or oil.

Water produces very rapid cooling and is not suitable for quenching many types of steel, for it produces excessive strains which warp and crack the steel. Hydrocarbon oils provide a relatively slow rate of cooling which is desired to produce certain physical properties, such as ductility, in steel. However, the slower cooling rate provided by oil quenching, although it prevents excessive strains in the metal, often prevents development of the desired hardness.

It, therefore, is desirable to provide quench liquids which will cool the metal at rates intermediate between oil and water quenches, whereby the greatest degree of hardness can be obtained without warping or cracking the steel. To this end various aqueous solutions and dispersions of organic compounds have been proposed as quenching fluids.

For example, U.S. Pat. No. 3,220,893 discloses a liquid quenching medium comprising an aqueous solution of a liqud oxyalkylene polymer having both oxyethylene and higher oxyalkylene groups and a molecular weight of 12,000 to 14,000. Such compounds are also referred to herein as polyether polyols and poly(oxyethylene-oxyalkylene)glycols. According to the patent, the oxyalkylene polymers have the characteristic of decreasing in solubility as the temperature of the quenching bath is increased, as when red hot metal is introduced therein. The oxyalkylene polymers are said to form a covering over the metal surface to the exclusion of the water component of the bath. The polymer layer is said to be an excellent heat conducting medium which operates at a high rate, and the use thereof requires relatively short quench cycle time, which results in minimum internal stress and distortion of the metal, while at the same time imparting uniform hardenability of the metal.

However, it is frequently desirable to increase the quench cycle time, and for such purposes organic compounds which cause the formation of a vapor blanket about the metal during the quenching operation have been used. An example of such an organic compound is a water-soluble polyacrylate, such as a sodium polyacrylate, the use of which compound in a quenching bath comprises the subject matter of U.S. Pat. No. 4,087,290.

An object of this invention is the provision of a novel quenching medium the composition of which can be varied to provide a broad range of quenching rates between the quenching rates of water and oil.

Another object of the invention is to provide a novel process for quenching heated material to obtain quenched metal parts of the desired physical properties and having a clean, bright metallic surface.

These and other objects will become apparent from the following description and appended claims.

According to this invention there is provided a novel quenching process useful in the heat treatment of metals. In the process the metal is heated to an elevated temperature and then quenched in a bath comprising an aqueous solution containing from about 0.5% to about 50%, by weight of the bath, of a liquid, water-soluble or water dispersable capped polyether polyol obtained by reacting ethylene oxide and at least one lower alkylene oxide having 3 to 4 carbon atoms with an active hydrogen compound to prepare a heteric or block copolymer, and further reacting the copolymer with an alpha olefin oxide, the polyol having a molecular weight of from about 7,000 to 15,000. Preferably the bath contains from about 3% to about 30% of the capped polyol, and such copolymer is prepared by reacting ethylene oxide and propylene oxide with a lower glycol or glycol to prepare a block copolymer, and the copolymer is further reacted with an alpha olefin oxide containing 12 to 30, preferably 14 to 18 aliphatic carbon atoms, the molecular weight of the copolymer being from about 12,000 to 15,000.

It was discovered that the capped polyether polyols used in the quenching bath of the novel process of this invention reduce the rate of cooling significantly as compared to same polyether polyols which are uncapped. This discovery is particularly surprising considering the fact that capping does not increase appreciably the molecular weight of the polyol, the capping compound, which is an alpha olefin oxide having a molecular weight only somewhat more than 200, whereas the molecular weight of the polyol may be as high as 15,000.

The mechanism by which the cooling rate of water is decreased by the presence of the capped polyether polyol is not fully understood. However, it is believed to be related to that property called inverse solubility, whereby solubility decreases with increasing temperature. As the hot metal piece is introduced to the quenching medium, the capped polyether polyol solute precipitates out on the hot surface of the metal, thermally insulating the quenched piece and thus decreasing its rate of cooling. As the temperature of the metal piece decreases the solute redissolves.

The capped polyether polyols used in the quenching process of this invention are relatively high molecular weight polyoxyalkylene compounds, which are capped by means of an alpha olefin oxide. The preferred polyols are alpha olefin oxide capped polyoxyethylene-polyoxypropylene block copolymers containing on the order of about 20 to 35%, by weight, of 1,2-propylene oxide groups.

The capped polyether polyols useful in the invention are preferably based on two types of normally liquid polyether polyols. Each type is obtained by reacting ethylene oxide, at least one lower alkylene oxide having 3 to 4 carbon atoms, and an active hydrogen compound. However, in one type of polyol, the active hydrogen compound is an aliphatic alcohol having two or more hydroxy groups in the molecule, while in the other type it is an aliphatic monohydric alcohol containing from 4 to 30 preferably 12 to 18 carbon atoms in the aliphatic group. In either instance, these polyether polyols, which may be heteric or block copolymers, are capped by reaction with an alpha olefin oxide having about 12 to 30 aliphatic carbon atoms. The molecular weight of the polyether polyols of both types should be on the order of 7,000 to 15,000, preferably about 12,000 to 14,000, and the weight percent of ethylene oxide groups should be on the order of 25% to 80%. Preferably, the copolymers contain about 20 to 35% of 1,2-propylene oxide groups.

Diols which may be used as the active hydrogen containing compound in the reaction are glycols, such as ethylene glycol, diethylene glycol and higher glycols. The diols may also contain oxyalkylene groups. Polyols containing more than two hydrogen groups, such as glycerin, polyglycerin, trimethylolpropane and the like, may also be used as the active hydrogen compound.

In preparing these polyether polyols, good results may be obtained by bringing a mixture containing the ethylene oxide and the lower alkylene oxide into intimate contact with the dihydroxy starting compound in the liquid phase, throughout which a suitable catalyst is uniformly dispersed. As catalyst, sodium and potassium hydroxide are preferred. The reaction is carried out at temperatures on the order of 50° C. to 160° C.

Such polyether polyols in which the active hydrogen compound is a diol and the process for their preparation are described in detail in U.S. Pat. No. 2,245,845, the disclosure of which patent is incorporated herein by reference.

As noted above, the alpha olefin oxides utilized to modify or cap the polyether polyols are those containing about 12 to 30, preferably 14 to 18 aliphatic carbon atoms, and mixtures thereof. A particularly preferred capped compound is tetradecyloxirane. The amount of alpha olefin oxide required to obtain the desired copolymers is such as to provide a mol ratio of polyol to capped compound of from 1:1 to 1:6. As the ratio increases the polymer becomes less water soluble.

The capping reaction is carried out by adding the alpha olefin oxide to the polyether polyol, a liquid, and heating the mixture to a temperature of about 50° C. to 90° C. for about 1 to 2 hours, depending upon batch size. Before addition of alpha olefin oxide, it is desirable to render the polyether polyol as anhydrous as possible. A $BF_3$ or KOH catalyst preferably is used.

A second type of preferred capped polyether polyols are those heteric or block copolymers of ethylene oxide, a lower alkylene oxide and an active hydrogen compound which preferably is a monohydroxy alcohol containing 4 to 30, preferably 12 to 18 aliphatic carbon atoms, capped with an alpha olefin oxide which contains 12 to 30 aliphatic carbon atoms. Such capped polyether polyols and methods for their preparation are disclosed in U.S. Pat. No. 4,288,639, the disclosure of which patent is incorporated herein by reference.

Typical of the preferred monohydric alcohols for reaction with ethylene oxide and a lower alkylene oxide are butyl alcohol, hexyl alcohol, octyl alcohol, lauryl alcohol, myristyl alcohol, stearyl alcohol, cetyl alcohol, eicosyl alcohol, ceryl alcohol and melissyl alcohol. The reaction is carried out using well known alkaline oxyalkylation catalysts, for example, strong bases such as sodium and potassium hydroxides. The reaction can be carried out in the presence of an inert organic solvent, examples of which include alphatic hydrocarbons, such as hexane and heptane; aromatic hydrocarbons, such as benzene and toluene; chlorinated hydrocarbons such as ethylene dichloride, and the like. Reaction temperatures are as stated above, i.e. on the order of 50° to 160° C.

Preparation of the latter polyether polyols is well known in the art. Further details of preparation of heteric copolymers of lower alkylene oxides are disclosed in U.S. Pat. No. 3,829,506, incorporated herein by reference. Additional information on preparation of block copolymers of lower alkylene oxides is to be found in U.S. Pat. No. 3,535,307, also incorporated by reference.

The polyether polyols in which the active hydrogen compound is a fatty alcohol are capped with an alpha olefin oxide as described herein above.

The molecular weight of the latter discussed capped polyols should be in the range of 7,000 to 15,000, preferably 12,000 to 14,000.

Other polyether polyols which may be capped to provide aqueous quenching baths according to this invention and methods for their preparation are disclosed in U.S. Pat. Nos. 2,425,755; 3,036,118; 3,595,924; 3,706,714; and 3,829,505; and British Pat. Nos. 950,844 and 1,228,461, the several disclosures of which are incorporated herein by reference.

In the quenching baths used in the process of this invention, the capped polyols will generally comprise from about 0.5% to about 50%, by weight, the amount depending upon the particular polyol employed and the cooling rate which is desired for the quenching medium. Preferably, the quenching baths contain on the average of about 3% to 30% of capped polyol.

The quenching rate generally decreases with increasing concentration of the capped polyether polyol. It also decreases as the molecular weight of the polyol increases and as the mol ratio of alpha olefin oxide oxide to polyether polyol increases from about 1:1 to 6:1. The quenching rate also generally decreases with increasing quenching bath temperatures measured prior to contact by the immersed hot metal, the preferred range of quenching bath temperatures being about 70° to 160° F. for most practical uses.

By adjustment of the above-mentioned factors of temperature of the quenching medium, molecular weight and concentration of the capped polyether polyol used in the quenching medium, and mol ratio of capping compound to polyol, a comparatively wide range of cooling rates can be obtained, which range lies between the rates for water and oil.

In addition to the essential capped polyol, the aqueous quenching baths used in the invention may contain other additives to improve performance in certain applications. For example, there may be added to the baths corrosion inhibitors such as sodium nitrite, ethanol amine or amine soaps, which prevent corrosion of quench tanks, conveyor belts and the quenched parts, as well as other additives, including defoamers, biocides, metal deactivators, etc.

The following examples more fully describe the quenching process of this invention, but are not to be construed as in any way limiting the scope of the invention.

Test Procedures

In each test the test specimen was a cylinder 500 millimeters long and 10 millimeters in diameter, and composed of scaleproof austenitic steel. A microthermocouple was inserted into the center of the cylinder, and the temperature-representing output of the thermocouple was recorded by means of a strip chart recorder (Chessell 321). The test specimen was heated in an electric resistance furnace which was operated without a controlled atmosphere and adjusted to a temperature of about 1700° F. (925° C.). In each test, the test specimen at the time of immersion in the quechant was 1620° F.

(849° C.). The quantity of quenchant used was 0.5 liters, and the temperature of the quenchant was 80° F. (27° C.).

Cooling curves were obtained using the above test conditions and aqueous solutions of various capped and uncapped polyether polyols. Cooling times during which the test specimens were cooled from 1600° F. (871° C.) to 400° F. (204° C.) were determined from the cooling curves. The results obtained are described hereinbelow.

EXAMPLE I

A capped polyether polyol was prepared by reacting 920 grams of a polyol of the general formula $$HOCH_2CH_2O\text{-}(CH_3)CHCH_2O\text{-}_x\text{-}CH_2CH_2O\text{-}_yCH_2CHCH_3OH$$

in which x and y are integers, and the polyol having a molecular weight of about 12,000 to 15,000, with 77 grams tetradecyloxirane

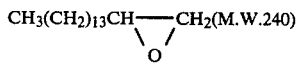

with approximately 80 grams of xylene as an azeotrope. After removal of the xylene, $BF_3$ is added as the catalyst. The reaction temperature was approximately 80° C. and the reaction time was about 5 hours. The resulting product was a liquid, 5% aqueous solution of which had a viscosity of about 11-12 centistokes at 100° F.

EXAMPLE II

Two quenching baths A and B were prepared, the former using the capped polyether polyol of Example I, and the latter using the uncapped polyether polyol employed to make the capped polyol of Example I. The composition of the quenching bath in each instance was as follows:

| Constituent | Weight Percent |
|---|---|
| Polyether polyol* | 3.9 |
| Defoamer | 0.001 |
| Rust inhibitor | 0.25 |
| Soft water | Balance |

*Capped in bath A, uncapped in bath B.

The cooling time for the metal test specimen to go from 1600° F. to 400° F. using quenching bath A, as determined from a cooling curve obtained as described above, was 7 seconds, as compared to 5.6 seconds for bath B. Thus, the capped polyether polyol advantageously decreased the cooling rate as compared to the uncapped copolymer.

EXAMPLE III

Three quenching baths C, D and E were prepared. Each of baths C and D contained 10% by weight, of a poly(oxyethylene-oxy-1,2-propylene)glycol (M.W. 20,000-35,000), and bath E contained 10% of the capped polyether of Example I. Cooling curves were obtained for all three baths and from these cooling curves it was determined that the times for the test specimens to cool from 1600° F. to 400° F. were: bath C, 10.8 seconds; bath D, 9.7 seconds; and bath E, 23.7 seconds. Here again, the capped polyether polyol (bath E) substantially decreases the cooling rate of the specimen as compared to similar uncapped polyether polyols.

EXAMPLE IV

A capped polyether polyol was prepared as described in Example I, with the exception that the mol ratio of the polyol to tetradecyloxirane was 1:2.1.

EXAMPLE V

Six quenching baths, F, G, H, I, J and K were prepared. Baths F, G and H each contained the capped polyether polyol of Example IV, the concentrations thereof being 10%, 20% and 30%, respectively, Baths I, J and K each contained poly(oxyethylene-oxy-1,2-propylene)glycol (M.W. 20,000), and the concentration of this polyether polyol in the respective baths was 10%, 20% and 30%.

Cooling curves for each of the baths were obtained as described above and from these curves the following cooling rates were derived:

TABLE I

| Bath | Concentration | Cooling Time (sec)* |
|---|---|---|
| F | 10% | 7.5 |
| G | 20% | 11.5 |
| H | 30% | 14.6 |
| I | 10% | 6.2 |
| J | 20% | 10.2 |
| K | 30% | 11.7 |

*From 1600° F. to 400° F.

These data show that the slower cooling character of the capped polyether polyol is exhibited at concentrations varying from 10% to 30%.

We claim:

1. In a process of quenching which is useful in the heat treatment of metals wherein a metal is heated to an elevated temperature and said heated metal is then quenched in a bath comprising a liquid quenching medium to effect desirable metallurgical changes in the metal, the improvement which comprises using as said quenching medium an aqueous solution containing from about 0.5% to about 50%, by weight, based on the total weight of the quenching medium, of a liquid, water-soluble or water-dispersible capped polyether polyol obtained by reacting ethylene oxide and at least one lower alkylene oxide having 3 to 4 carbon atoms with an active hydrogen compound to prepare a heteric or block copolymer having a molecular weight of from about 7,000 to about 15,000, and further reacting said copolymer with an alpha olefin oxide.

2. A process according to claim 1 in which said polyol is obtained by reacting ethylene oxide and 1,2-propylene oxide with a lower glycol to prepare a block copolymer, and further reacting said copolymer with an alpha olefin oxide containing about 12 to 30 aliphatic carbon atoms, said copolymer containing on the order of about 20% to about 35% 1,2-propylene oxide groups.

3. A process according to claim 1 in which the mol ratio of copolymer to said alpha olefin oxide is from about 1:1 to about 1:6.

4. A process according to claim 1 in which said polyol is obtained by reacting ethylene oxide and 1,2-propylene oxide with an aliphatic monohydric alcohol having 4 to 30 carbon atoms in the aliphatic group to prepare a block copolymer having a molecular weight of from about 7,000 to about 15,000, and further reacting said copolymer with an alpha olefin oxide containing about 12 to 18 aliphatic carbon atoms, said copolymer containing on the order of about 20% to about 35% 1,2-propylene oxide groups.

5. A process according to claim 4 in which the mol ratio of said copolymer to said olefin oxide is from about 1:2 to about 1:4.

6. A process of quenching which is useful in the heat treatment of metals wherein a metal is heated to an elevated temperature and said heated metal is then quenched in a bath comprising a liquid quenching medium to effect desirable metallurgical changes in the metal, the improvement which comprises using as said quenching medium an aqueous solution containing from about 3% to about 30%, by weight, based on the total weight of the quenching medium, of a liquid, water-soluble or water-dispersible capped polyether polyol obtained by reacting ethylene oxide and 1,2-propylene oxide with ethylene glycol, propylene glycol, or mixtures thereof, to prepare a block copolymer containing on the order of about 20% to about 35% 1,2-propylene oxide groups, said copolymer having a molecular weight of from about 12,000 to 14,000, and further reacting said copolymer with an alpha olefin oxide having 12 to 18 aliphatic carbon atoms, the mol ratio of said copolymer to said alpha olefin oxide being in the range of from about 1:2 to about 1:4.

7. The process according to claim 6 in which said alpha olefin oxide is tetradecyloxirane.

* * * * *